United States Patent [19]

Guillermet et al.

[11] Patent Number: 4,681,665

[45] Date of Patent: Jul. 21, 1987

[54] PROCESS AND APPARATUS FOR ELECTROCHEMICAL TREATMENT OF THE SURFACE OF METAL PRODUCTS OF ELONGATE SHAPE

[75] Inventors: Robert Guillermet, Rives; Michel Ladet, Seyssinet; Gérard Laslaz; Claude Le Bars, both of Voiron, all of France

[73] Assignee: Aluminium Pechiney, Paris, France

[21] Appl. No.: 583,232

[22] Filed: Feb. 24, 1984

[30] Foreign Application Priority Data

Mar. 16, 1983 [FR] France ..... 83 04612

[51] Int. Cl.[4] ..... C25D 11/02; C25D 19/00

[52] U.S. Cl. ..... 204/14.1; 204/28; 204/130; 204/211; 204/228; 204/267; 204/56.1

[58] Field of Search ..... 204/14.1, 28, 206–211, 204/228, 267, 130, 56 R, 58

[56] References Cited

U.S. PATENT DOCUMENTS

| | | | |
|---|---|---|---|
| 2,267,146 | 12/1941 | Wilson | 204/206 |
| 3,420,760 | 1/1969 | Freedman et al. | 204/145 |
| 3,453,201 | 7/1969 | Mihara et al. | 204/301 |
| 3,471,375 | 10/1969 | Cooke et al. | 204/28 |
| 3,755,116 | 8/1973 | Terai et al. | 204/129.95 |
| 4,214,961 | 7/1980 | Anthony | 204/140 |

*Primary Examiner*—John F. Niebling
*Assistant Examiner*—William T. Leader
*Attorney, Agent, or Firm*—Oblon, Fisher, Spivak, McClelland & Maier

[57] ABSTRACT

The present invention relates to a process and apparatus for electrochemical treatment in a static mode or in a feed motion mode of the surface of metal products of elongate shape.

The process is characterized in that cathodic and anodic zones are produced within the same volume of electrolyte, the zones being separated from each other and being displaced parallel to the product in a cyclic manner.

The process is carried out in a cell having a single compartment in which there are at least four electrodes, two of which have voltage applied thereto.

The invention is applied more particularly to aluminium, magnesium, titanium and alloys thereof, in order to provide for regular treatment of the entire surface of the product.

5 Claims, 5 Drawing Figures

Figure 1:
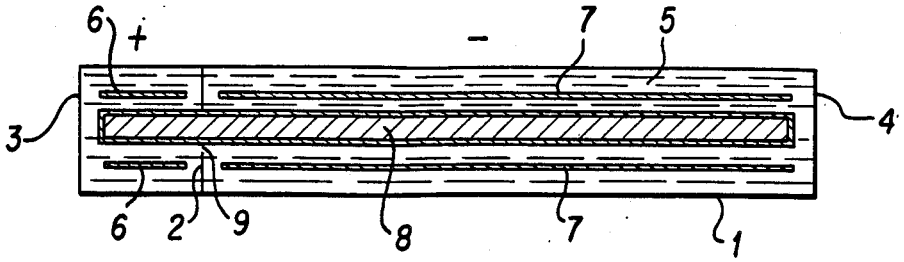

| | A | B | C | D | E | F | G | H | I | J | K | L | M | N | O | P | Q | R | S | T |
|---|---|---|---|---|---|---|---|---|---|---|---|---|---|---|---|---|---|---|---|---|
| 0 | + | + | + | + | + | | | | | | − | − | − | − | − | | | | | |
| 1 | + | + | + | + | | | | | | − | − | − | − | − | | | | | | + |
| 2 | + | + | + | | | | | | − | − | − | − | − | | | | | | + | + |
| 3 | + | + | | | | | | − | − | − | − | − | | | | | | + | + | + |
| 4 | + | | | | | | − | − | − | − | − | | | | | | + | + | + | + |
| 5 | | | | | | − | − | − | − | − | | | | | | + | + | + | + | + |
| 6 | | | | | − | − | − | − | − | | | | | | + | + | + | + | + | |
| 7 | | | | − | − | − | − | − | | | | | | + | + | + | + | + | | |
| 8 | | | − | − | − | − | − | | | | | | + | + | + | + | + | | | |
| 9 | | − | − | − | − | − | | | | | | + | + | + | + | + | | | | |
| 10 | − | − | − | − | − | | | | | | + | + | + | + | + | | | | | |
| 11 | − | − | − | − | | | | | | + | + | + | + | + | | | | | | − |
| 12 | − | − | − | | | | | | + | + | + | + | + | | | | | | − | − |
| 13 | − | − | | | | | | + | + | + | + | + | | | | | | − | − | − |
| 14 | − | | | | | | + | + | + | + | + | | | | | | − | − | − | − |
| 15 | | | | | | + | + | + | + | + | | | | | | − | − | − | − | − |
| 16 | | | | | + | + | + | + | + | | | | | | − | − | − | − | − | |
| 17 | | | | + | + | + | + | + | | | | | | − | − | − | − | − | | |
| 18 | | | + | + | + | + | + | | | | | | − | − | − | − | − | | | |
| 19 | | + | + | + | + | + | | | | | | − | − | − | − | − | | | | |
| 20 | + | + | + | + | + | | | | | | − | − | − | − | − | | | | | |

FIG. 5

PROCESS AND APPARATUS FOR ELECTROCHEMICAL TREATMENT OF THE SURFACE OF METAL PRODUCTS OF ELONGATE SHAPE

The present invention relates to a process and an apparatus for electrochemical treatment, in a static mode or in a feed motion mode, of the surface of metal products of elongate shape such as bars, round rods, shaped members, strips, wires, etc.

More particularly it concerns the anodisation of metals and alloys based on aluminium, magnesium and titanium.

In metallurgy, it is known to subject certain metal products to a treatment which is intended to modify the surface condition thereof, more specifically to impart to the surface properties which are different from those of the substrate, whether from the point of view of resistance to corrosion, mechanical strength, suitability for coating, aesthetic appearance or the like.

That treatment may be performed in particular by an electrochemical process which comprises immersing the product in a solution of electrolyte and at the same time subjecting it to the action of an electrical current so as to develop at the surface thereof differently charged zones such as anodic zones with a positive charge and cathodic zones with a negative charge. Under the chemical action of the electrolyte and the electrical action in the zones, the metal of the substrate is transformed at the surface of the product into a new compound and/or a substance produced from the solution is deposited on the surface of the product.

Thus for example aluminium, is protected from agents in the atmosphere by a treatment which is referred to as anodisation, which comprises immersing the product in an oxygen acid such as sulphuric acid and developing an anodic zone in such a way that an artificial oxide layer having improved corrosion resistance over the natural oxide layer is formed at the surface of the product under the combined action of the two means referred to above.

Likewise, certain products may be coloured in order to enhance the aesthetic effect thereof by immersing them into a solution of a metal salt and developing a cathodic zone so as to cause a coloured substance to be deposited on the product from the electrolyte solution.

In the treatment art, as moreover in most other arts, the problem of competition between the manufacturers of products occurs to an increasing extent, and hence the necessity to minimise the cost prices of products. That requirement led the man skilled in the art constantly to seek to improve his procedures and in particular the hourly production capacity of treatment units without thereby adversely affecting the quality of the products and without increasing to the same proportion the capital investment costs and operating costs of the installations used.

Now, capital investment costs are in particular linked to the sizes of the apparatuses while operating costs depend primarily on the levels of consumption of electric power per unit of surface treated, labour costs and speed of treatment.

The efforts made by the man skilled in the art therefore seek to achieve a reduction in such costs.

In order to given a better idea of the problems involved, it should be recalled that electrochemical treatment processes are conventionally carried out in equipment comprising one or more tanks which are elongate in a vertical or a horizontal direction and which are filled with electrolyte and in which the product is immersed, either by fixing it therein, if the process is carried out in a static mode, or, in contrast, by causing the product to be displaced along the tanks, with the product being guided in that movement, in the case of a process which is carried out in a feed motion mode.

The tank or tanks are combined together, and are known as a cell, the cell generally being provided on its side walls with one or more electrodes which dip into the electrolyte without having any mechanical contact with the product to be treated, and which are connected to one of the poles of the generator. As regards the other pole, two main connecting modes are employed at the present time.

In the first connecting mode, the connection is made directly by mechanical contact with the product by way of means which differ depending on whether the process is a static mode process or a feed motion mode process.

In the former case, the said means comprises a gripping arrangement which uses either screws, jaws or clamps, being connected to the generator by flexible cables and being applied to one of the ends of the product to be treated. In order for that form of connection to be effective, the area of contact as between the product and the gripping arrangement must be sufficiently large, and especially so in proportion to increasing strength of the current to be used. However, it will be apparent that, under those conditions, the surface which is engaged by the gripping arrangement cannot be subjected to the combined action of the electrolyte and the electric current so that that surface portion will not be treated and it therefore has to be scrapped in order to produce a product which has been homogeneously treated. That therefore reduces the material yield of the process, the reduction in output increasing as increasing current strengths are used.

In addition, with such a connecting mode, each treatment operation is accompanied by operations for fitting and removing the gripping arrangement on the product, thereby increasing the labour costs and reducing the speed of treatment and thus contributing to an increase in cost price. That disadvantage may be reduced by automating such arrangements, but only by means of high levels of investment which, in the ultimate analysis, will also have an adverse effect on the cost price of the treated products.

In the case of a feed motion mode process, the connecting means which involves connection by mechanical contact is required to permit free movement of the product through the electrolyte solution. This process therefore involves having recourse to arrangements for the direct feed of current by a frictional action or by using rotary rollers. However, because of the relatively substantial speeds of translatory movement of the product, which have to be attained in order to make the process an attractive proposition, those arrangements often reslt in the formation of electric arcs or sparks which cause a local change in the surface of the products and accordingly have an adverse effect on the homogeneity of the electrochemical treatment.

This first connecting mode using mechanical contact on the product is very well suited to using a single electrolyte tank. The situation is different in regard to the second connecting mode where the electrical connection of each of the poles of the generator is effected in the same manner by means of electrodes and a volume of electrolyte, and where two separate tanks are used: a treatment tank in the strict sense and a tank which is referred to as the liquid current pick-up or collector tank, the product to be treated being disposed within those tanks.

The two tanks are generally contiguous and are elongate in the same direction, the second tank often being shorter than the first tank. In practice, the two tanks may be produced from a cell which is divided into two compartments by means of a transverse partitioning wall.

With such a connecting mode, the electrical circuit used may be illustrated by taking the example of a direct current anodisation process. Disposed in succession therein are the electrodes of the liquid current pick-up which are connected to the positive pole of the generator, the layer of electrolyte separating those electrodes from the surface of the product which is positioned in the pick-up, which contributes to developing a cathodic zone in the vicinity of the product, the length of the product between said zone and the anodic zone which is in the treatment tank, and the layer of electrolyte which separates the last-mentioned zone from the electrodes connected to the negative pole of the generator.

Such a form of connection is a substantial improvement in comparison with direct connection by mechanical contact as, in a static mode process, it eliminates all the operations of fitting and removing the gripping arrangements while in a feed motion mode process, it eliminates the problems of arcing or sparking. However, it does not solve the problem of heterogeneity of treatment as the part of the product which is in the liquid current pick-up area is still in a zone of opposite polarity to the polarity required for the treatment, and cannot therefore undergo that treatment. That part of the product therefore has to be scrapped and recycled, just as in the case of making the connection by contact.

Such a form of connection may also be used in a feed motion mode treatment process as disclosed moreover in the Japanese patent application published under the No. 52 59037.

In fact, that application provides that a strip of metal is continuously anodised in a cell having a partitioning wall member which is no longer transverse but longitudinal, so as to provide an anodic chamber and a cathodic chamber which are elongate in the direction of translatory movement of the product.

It is apparent that, with such an arrangement, the whole of the part of the strip which is in the cathodic zone must in this case also be scrapped in order to have a product which has been homogeneously treated, thus giving rise to wastage of material which is even more substantial than in the case of the static mode process.

However, those are not the only disadvantages of that connecting mode for problems of electrical losses in the electrolyte are also encountered.

It is known in fact that electrical current preferably follows the path of least resistance. If there is not a perfect seal between the current pick-up compartment and the treatment compartment, there will be a tendency in the course of treatment for it to flow through the electrolyte rather than passing through the product. Accordingly, it will simply serve to heat the electrolyte by a Joule effect and will not participate in the treatment in the true sense, hence resulting in a reduction in the electrical efficiency of the installation.

It is true to say that the above-indicated problem of giving a good seal may be overcome by moving the tanks apart but in that case, on the one hand the dimensions of the installation become prohibitive and on the other hand, if the process is carried out in a static mode, the length of the product which remains untreated is further increased.

There is therefore no option but to use contiguous tanks and to provide the separating walls with suitable sealing means. That is all the more complicated insofar as such means must be suited to each type of configuration of the product being treated and, in a process which is carried out in a feed motion mode, they must be capable of withstanding without damage the rubbing effect caused by the movement of the product.

In order to avoid a heterogeneous treatment, it has been proposed, in a process which is carried out in a feed motion mode, with liquid current pick-up, that cells may be used which comprise a succession of anodic and cathodic compartments through which the product passes. However, this arrangement also falls foul of the problem of electrical losses in the electrolyte. In addition it is noted in such cells that the layer of oxide formed, for example in the course of anodisation in the anodic compartment, suffers damage or 'breakdowns' if the amount of current in the cathodic compartment exceeds a certan value. Thus, in the presence of an electrolyte such as sulphuric acid, such breakdowns occur as soon as about 150 coulombs/cm$^2$ is exceeded.

In consequence, in order to limit the current, the number of compartments has to be multiplied, more particularly in proportion to increasing thickness of the layer of oxide which is to be produced. For example, for an anodisation effect of type 15, at least 30 compartments, each 0.5 meter in length, have to be used, which results in the cell being of excessive size.

In conclusion, in the processes and apparatuses of the prior art, there are the problems of heterogeneity of treatment, which are the cause of products being scrapped, excessive size of the cells under certain circumstances, waste of time, and labour costs arising out of the fitting and removing operations when using current pick-up arrangements involving mechanical contact, constraints in regard to the levels of current density in the cathodic compartments, and electrical current leakage in the electrolyte, those disadvantages resulting in an increased cost price.

The solutions to such problems, such as multiplying the number of compartments and using more or less sohpisticated sealing means, are not entirely satisfactory by virtue of the capital investment costs that they involve.

It is for that reason that the present applicants, seeking to make their contribution to the problems raised by the electrochemical treatment of metal products, conceived and made the present invention in the aim of reducing the cost price while providing for homogeneous treatment without breakdowns of the product over the entire surface thereof, limiting the problems of electrical sealing and current losses which derive therefrom, and using a cell whose length is substantially equal to the length of the product in the case of a treatment carried out in a static mode.

The invention first concerns a process for electrochemical treatment, in a static mode or in a feed motion mode, of the surface of metal products of elongate shape, wherein the product is immersed in the same volume of electrolyte and an electrical current is passed therethrough by means of said electrolyte to develop on said product simultaneously at least one essentially cathodic zone and one essentially anodic zone. The process is characterised in that said zones are displaced simultaneously all along the product, while remaining separated from each other.

That process therefore involves the mode of connection to the generator by the liquid current pick-up means, since the electric current is passed through the product by way of the electrolyte to develop the anodic and cathodic zones required for carrying out the treatment.

However, this process also has the particular feature of providing essentially anodic and cathodic zones which are produced in the same volume of electrolyte.

The foregoing discussion of the conventional processes showed that, in the case of a liquid current pick-up arrangement, the cathodic and anodic zones were always in two different tanks or in two compartments of the same cell which are separated by a sealed partitioning wall, which involved two separate masses of electrolyte. In the present invention, there is only a single mass of electrolyte in which the two zones of different polarities are developed at the same time.

That therefore greatly simplifies the structure of the cell since it becomes a single-compartment cell.

A feature of the process comprises having zones which are elongate parallel to the axis of the product to be treated over a certain length but which are separate, that is to say, they are not adjacent and there is a portion of product between the two zones, which is neither essentially cathodic nor essentially anodic. That makes it possible to reduce the losses of current through the electrolyte.

The space between two zones cannot be fixed a priori as it depends on the operating parameters of the treatment operation. However, it is so determined as to have a reduced current loss with respect to the treatment current.

As regards the length of the zones themselves, they must comply with the requirement that it is not possible to exceed a certain amount of current per unit of surface area of the product to be treated, in particular in the cathodic zones, if breakdowns of the layer of oxide in the case of anodisation for example are to be avoided. However, there is also a link to the desired production of the cell which, in the case of anodisation, depends on the amount of current introduced into the anodic zone and consequently the length thereof.

A compromise therefore has to be sought in this case also, which can be achieved by taking for example anodic and cathodic zones of different lengths.

Another original feature of the process according to the invention lies in the fact that the zones are simultaneously displaced all along the product. That displacement or sweep motion is effected simultaneously so that, in the course of one operation, the zones retain their initial length and remain spaced from each other at the same distance. The zones are displaced all along the product, that is to say, each portion of the product, even in the static mode process, whether it is at the end or at the middle of the length contained in the cell, is positioned at least once in an essentially anodic zone and then in an essentially cathodic zone, or vice-versa.

In that way the entire surface of the product is treated anodically for example in an anodisation or etching operation or cathodically for example in a colouring operation, and there is therefore no heterogeneity of treatment from one point of the product to another so that the operation will not subsequently involve wasting material.

In addition, the sweep motion may be carried out at a suitable speed for admitting, in passing through a zone, a given amount of current per unit of surface area, which does not exceed for example in regard to anodisation the critical amount of breakdown current. However, a single pass may be found to be insufficient to provide the amount of current required for the treatment. It is for that reason that the sweep operation is also performed cyclically, that is to say, in the course of an operation, an anodic zone for example which has passed along the entire length of the product contained in the cell passes along the whole of that same length again, one or more times, and likewise in regard to the other zones and spaces. Each sweep from one end to the other constitutes a cycle and that cycle is therefore repeated n times.

The speed of the sweep motion in the course of the n cycles may be constant or may be varied, depending on the problem to be solved. It is therefore possible to establish a periodicity which may or may not be regular.

It is also possible to establish a mode of treatment operation in which each cycle or group of cycles is different from the following cycle and the group of following cycles, either in regard to the length of the zones or the spaces between zones, or in regard to the mutual disposition of the zones. Thus, in the course of a cycle or a group of cycles, it is possible to have anodic and cathodic zones of the same length and then, in the course of another cycle or another group of cycles, the zones or the spaces between zones may be of different lengths. A wide range of possibilities based on the sweep motion and the variation in the configuration of the electrical states can thus be achieved without departing from the scope of the invention.

In the case of treating the product in a feed motion mode, the speed of displacement of the zones is higher than the speed of translatory movement of the product through the cell, by an amount sufficient to be able to enjoy the benefit of the advantages of the sweep motion. The speed used will preferably be more than twice the speed of translatory movement of the product.

The invention also concerns a particular apparatus for carrying out the process.

This apparatus comprises, in conventional manner, a cell of elongate shape, having a single compartment which contains a solution of electrolyte within which the product to be treated is immersed, the cell being provided on its longitudinal walls with electrodes which dip into said solution, being disposed in the vicinity of a part at least of the periphery of the component and being capable of being supplied with power by one of the poles of an electrical generator so as to create essentially anodic and cathodic zones by the flow of a current through a fraction of the volume of the solution and over a portion of the length of the product.

However, it is distinguished from the prior-art apparatuses in that the electrodes form at each moment at least one array of four successive groups of at least one electrode per group, each array comprising in the same direction two groups which are supplied by each of the poles of the generator, two groups which are not supplied and of which one is disposed between the two preceding groups, and the other following same, that, in accordance with a certain program, at least one of the electrodes disposed at the end of each of the groups changes in electrical state so that over the entire length of the cell there is the same electrical configuration but shifted by at least one electrode along the cell, the shift at one of the ends of the cell being carried over to the other end.

Thus, the apparatus according to the invention reproduces the elements of the conventional apparatuses, namely, a liquid current pick-up cell which makes it possible to contain the product to be treated over at least a portion of the length thereof and the electrolyte solution and whose walls are provided with a series of electrodes separated from each other, which can completely surround the product or simply extend parallel to one or both large faces of the product depending on whether one or both sides of the product are to be treated. However, instead of having a plurality of compartments, the cell has only a single compartment.

In addition, in order to effect displacement or sweep motion of the zones, the above-mentioned electrodes must form at least one array of four successive groups. Each group may comprise one or more electrodes but each array comprises two groups which are fed by the opposite poles of the generator. Those two groups each provide an electrical circuit which is formed on the one hand by the volumes of electrolyte which are disposed between the electrode or electrodes of each of the groups fed from the generator and the product and which constitute the anodic and cathodic zones, and, on the other hand, the length of the product which separates the two zones.

Between those two groups, and following same, there are two groups of electrodes which are not supplied and which provide for separation of the polarised zones from each other. For example, considering a cell having a single array, in a longitudinal cross-section of the cell, there is a succession of groups 1 - 2 - 3 - 4. At a time t, the groups 1 and 3 are each supplied by one of the poles of the generator while the groups 2 and 4 are not. At the time t+1, the groups 1 and 3 are no longer supplied and the poles of the generator supply the groups 2 and 4 in the same order. At the time t+2, the supplied electrodes are the same as at time t but at opposite polarities; likewise, at time t+3, the electrodes 2 and 4 are supplied as at time t+1 but with opposite polarities.

The apparatus provides an electrical sweep motion along the array of the four groups of electrodes, which results in displacement of the zones. When each group comprises a plurality of electrodes, the sweep motion may be effected electrode by electrode so as to produce an electrical slip movement and displacement of the zones which no longer takes place by sectors but in steps.

When the cell comprises a plurality of arrays, the sweep motion is so produced as to establish a certain synchronism between the arrays and to give identical electrical states in each group at a given time.

Depending on the particular type of treatment and the productivity sought to be achieved, the apparatus is supplied with electrical power by one or more independent current and voltage controlled sources which may or may not be synchronised to the frequency of the mains and which are connected to the electrodes.

The cyclic sweep of the connections involves, upon displacement of the configurations concerned, cutting off and restoring the supply of power to a certain number of electrodes in accordance with the cut-out in respect of time and in respect of number of electrodes, which is predetermined in advance.

That function is performed by an electrical current power switch which is selected from different systems and combinations thereof such as automatic disconnection switches, pneumatic or electromagnetic contactor switches, power relays, bipolar power transistors, field effect power transistors, thyristors (SCR ) TRIAC, controlled thyristors (G.T.O.) or any system capable of peforming the function of supplying and cutting off current.

The power supply systems are controlled in accordance with the rapidity and the complexity of the cycles envisaged by various electrical means producing a sequential logic. Among same, mention may be made of rotary electrical current change-over switches, sets of electromagnetic relays, static wired switching circuits, programmable automatic devices, and data processing systems based on microprocessors or minicomputers.

However, it is also possible to envisage other apparatuses for carrying out the process according to the invention. Thus, it is possible to provide for mechanical displacement of the electrodes along the cell, for example by means of an endless chain system. In that case, there is no longer any need to use a program for electrical connection and disconnection, and each electrode can permanently remain of the same polarity. Likewise, it is possible to omit the groups of electrodes which were provided to separate the anodic and cathodic zones.

Figure 2:
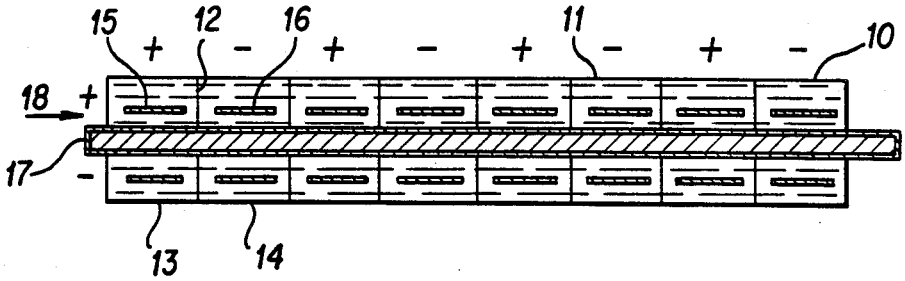
Figure 3:
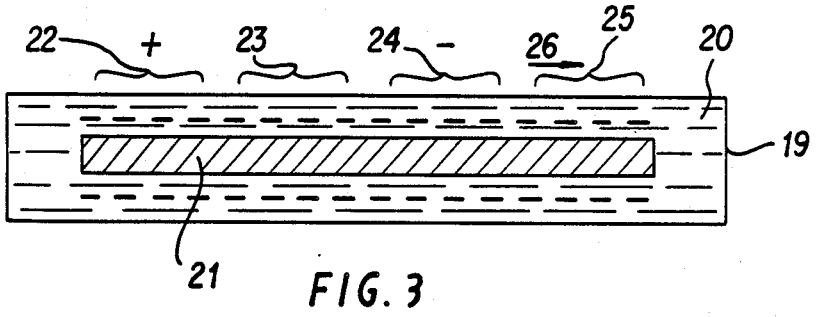
Figure 4:
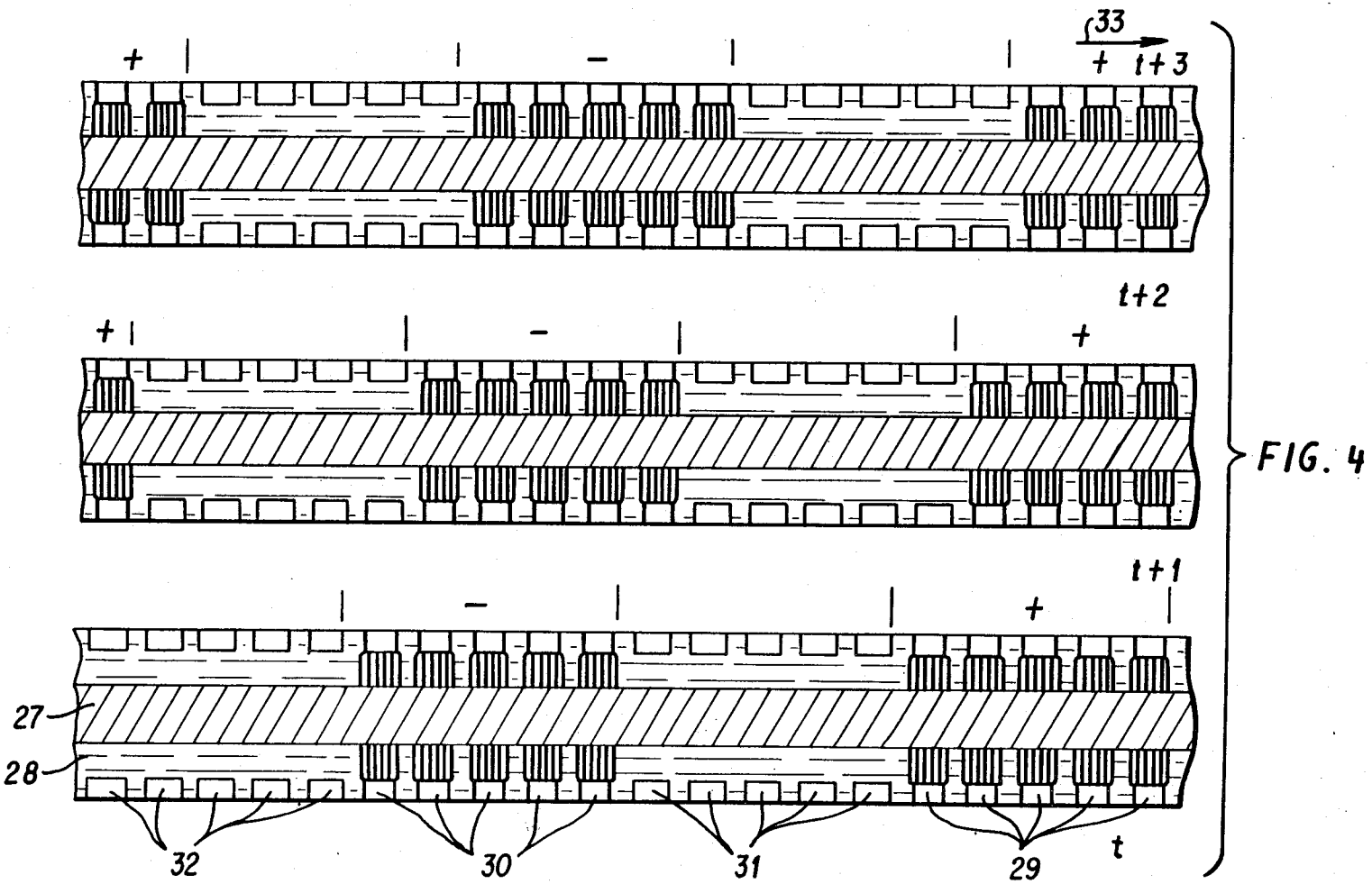

The present invention will be better appreciated by reference to the accompanying drawings in which:

FIG. 1 shows a plan view in cross-section of a prior-art cell having two compartments, FIG. 2 is a view in longitudinal section of a multicompartment cell which is also part of the prior art, FIG. 3 shows a view in longitudinal section of a cell according to the invention, FIG. 4 shows the state of connections of the electrodes at three successive times in the process according to the invention, and FIG. 5 is a diagram showing the electrical states of the electrodes in the course of a complete cycle.

Referring to FIG. 1, shown therein is a plan view in cross-section of a cell of outline 1 which is separated by a partitioning wall 2 into a cathodic compartment 3 and an anodic compartment 4 filled with an electrolyte 5, provided with an anode 6 and a cathode 7 which extend parallel to the two large surfaces of a product 8 to be treated.

That product which may circulate in a direction perpendicular to the plane of the drawing has two portions delimited by the sealed opening 9 provided in the partitioning wall 2.

It will be seen that only the portion to the right of the partitioning wall is disposed in an anodic zone and can be anodised, which results in the portion of product which is to the left of the partitioning wall being scrapped.

In FIG. 2, the cell 10 which is filled with an electrolyte 11 comprises a series of partitioning walls 12 forming cathodic and anodic compartments 13 and 14 respectively, provided with anodes 15 and cathodes 16, in which cathodic and anodic zones respectivley are produced. The product 17 circulates in the cell in the direction indicated by reference numeral 18 and, in an anodisation process, the layer of oxide is formed when the product passes through each anodic cell. Such an apparatus does not require a portion of the product to be scrapped but, having regard to the relatively limited speed at which the product can move and the need to operate at current densities in the cathodic compartment which are below a critical value, it is necessary to have a large number of compartments in order to carry out the desired treatment.

FIG. 3 shows a view in longitudinal section of a cell according to the invention, showing the cell body 19 filled with electrolyte 20 in which the product 21 to be treated is immersed. An array of four groups 22, 23, 24 and 25 is distributed along the cell. At a time t, the electrodes 22 and 24 are connected to the positive and negative poles of an electrical generator (not shown) so as to produce cathodic and anodic zones in their respective vicinities, and the electrodes 23 and 25 are not supplied with power so as to separate the cathodic and anodic zones.

By sliding the power supply locations in the direction indicated by the arrow 26, the cathodic and anodic zones are displaced along the product whereby the entire surface thereof is successively swept by zones of opposite polarities and is therefore subjected to the treatment.

FIG. 4 shows the state of connection of the electrodes in the cell at times t, t+1 and t+2. FIG. 4 shows at 27 the product which is immersed in the electrolyte 28, and an array of four groups each comprising five electrodes: a positively charged group 29 producing a cathodic zone, a negatively charged group 30 producing an anodic zone, a group 31 which is not supplied with power and which is between the groups 29 and 30, and a group 32 which is not supplied with power and which follows the group 30 in the direction of displacement of the zones as represented by the arrow 33.

The displacement of the zones is effected in this case by a stepwise sliding movement, the electrical configuration at two successive times t and t+1 or t+1 and t+2 corresponding to a shift of one electrode.

FIG. 5 is a diagram showing twenty electrical configurations which occur in the course of a cycle in a cell provided with twenty electrodes indicated by letters A, B . . . T and in which each displacement which is indicated by references 0 to 20 occurs electrode by electrode. Initially, the electrodes A B C D E are supplied with positive current and the electrodes K L M N O are supplied with negative current while the electrodes F G H I J and P Q R S T are not supplied with power. That arrangement therefore forms an array of four groups in which the groups which are supplied with power are separated by a group which is not supplied with power. That same arrangement occurs in the course of the twenty successive displacements, at the end of which the intial configuration reappears. It can be seen that, at the ends of the cell, the electrical configuration is modified as if the electrodes A and T were adjacent to each other.

The invention may be illustrated by means of the following example of use thereof: a shaped member of aluminum alloy of type 6000 in accordance with the standards of the American Aluminium Association, being 6 meters in length with the perimeter of its section being 0.30 meter, was subjected to an anodisation treatment using a solution of sulphuric acid containing 200 g/liter in a cell of similar length, with a cross-sectional area of 0.03 $m^2$ and provided with 100 electrodes distributed regularly all along the cell and with centre-to-centre spacings of 0.06 meter. The electrodes were supplied with power in such a way as to form four zones, each 1.5 meter in length: an anodic zone and a cathodic zone separated by a non-polarised zone and the cathodic zone being extended by a zone which is also non-polarised. Those zones are displaced electrode by electrode at a speed of 0.4 meter/second.

The current density in each of the polarised zones was $12A/dm^2$.

For an oxide thickness of 15 $\mu m$, the period of time for which operation was effected was 20 minutes and the current loss due to leakage in the electrolyte was less than 5%, which is a good compromise between productivity and electrical efficiency.

The present invention can be used in any electrochemical treatment of metals of elongate shape, in a static mode or in a feed motion mode, whether it is intended for anodisation, etching, colouring, galvanisation or any other surface modification and in respect of which there is a wish for regular treatment of the entire surface of the product under optimum conditions in regard to operating costs and at a reduced level of capital investment cost.

It is found to be a particularly attractive proposition in coating aluminum and alloys thereof.

It may easily be extended to the treatment of magnesium and titanium and derivatives thereof.

We claim:

1. A process for electrochemical treatment, within an elongated electrochemical cell, of the surface of metal products, wherein the products are static or in movement along the length of said cell comprising the steps of:

providing an elongated electrochemical treatment cell with a single compartment containing an electrolyte;

providing the cell with a plurality of electrodes positioned along its walls and forming at least four groups;

passing current through the electrodes for developing successively along the length of the cell an anodic group, a non-charged group, a cathodic group, and non-charged group spaced apart from each other;

electrically switching simultaneously said anodic group, said non-charged group, said cathodic group, and said non-charged group successively along the length of the cell at a speed greater than the speed of said product when said product is in motion.

2. A process according to claim 1 wherein the electrical switching is effected at a controlled speed.

3. A process according to claim 1 wherein the electrical switching is effected cyclically.

4. A process according to claim 1 wherein, when the product is in movement, the speed of electrical switching of the groups is greater than double the movement speed of the product.

5. An apparatus for electrochemical treatment of the surface of metal products comprising:

an elongated treatment cell with a single compartment containing an electrolyte;

a plurality of electrodes dipping into the said electrolyte and positioned along the walls of the cell forming at least four groups of at least one electrode per group;

a power source connected to the electrodes and supplying current in such a manner a have along the length of the cell successively an anodic group of non-supplied group, a cathodic group, and a non-supplied group;

means for switching the power source to said anodic group, said non-supplied group said cathodic group, and said non-supplied group such that the electrical connections are simultaneously shifted from one group to the next successive group.

* * * * *